United States Patent [19]

Hensel et al.

[11] Patent Number: 4,887,559

[45] Date of Patent: Dec. 19, 1989

[54] SOLENOID CONTROLLED OIL INJECTION SYSTEM FOR TWO CYCLE ENGINE

[75] Inventors: Robert J. Hensel; William G. Fenrich, both of Oshkosh, Wis.

[73] Assignee: Brunswick Corporation, Skokie, Ill.

[21] Appl. No.: 176,698

[22] Filed: Apr. 1, 1988

[51] Int. Cl.[4] ..... F01M 3/02; F02B 33/04

[52] U.S. Cl. ..... 123/73 AD

[58] Field of Search ..... 123/73 R, 73 A, 73 AD, 123/196 R

[56] References Cited

U.S. PATENT DOCUMENTS

| | | | |
|---|---|---|---|
| 3,924,975 | 12/1975 | Hundertmark | 417/395 |
| 4,305,351 | 12/1981 | Staerzl | 123/73 A |
| 4,388,896 | 7/1983 | Sheridan et al. | 123/73 AD |
| 4,480,602 | 11/1984 | Kobayashi et al. | 123/73 AD |
| 4,512,292 | 4/1985 | Hundertmark | 123/65 B |
| 4,583,500 | 4/1986 | Hundertmark | 123/73 AD |
| 4,590,897 | 5/1986 | Hundertmark | 123/73 A |
| 4,632,085 | 12/1986 | Misawa et al. | 123/73 AD |
| 4,699,109 | 10/1987 | Hensel | 123/458 |
| 4,702,202 | 10/1987 | Hensel et al. | 123/52 M |

FOREIGN PATENT DOCUMENTS

| | | | |
|---|---|---|---|
| 0016212 | 1/1982 | Japan | 123/73 AD |
| 0014415 | 1/1986 | Japan | 123/73 AD |

*Primary Examiner*—Willis R. Wolfe

*Attorney, Agent, or Firm*—Andrus, Sceales, Starke & Sawall

[57] ABSTRACT

An oil injection system is provided for a two cycle crankcase compression internal combustion engine. A crankcase pressure driven oil pump (70) draws oil from an oil source (52, 54) and delivers pumped oil through an oil output line (64) to the fuel supply system. A solenoid valve (72) in the oil output line controls the flow of pumped oil to the fuel supply system.

6 Claims, 2 Drawing Sheets

SOLENOID CONTROLLED OIL INJECTION SYSTEM FOR TWO CYCLE ENGINE

BACKGROUND AND SUMMARY

The invention relates to oil injection systems for two cycle internal combustion engines, for providing a fuel-oil mixture to the engine.

It is known in the art to provide an oil injection system using an oil pump driven by a worm gear arrangement on the crankshaft for example U.S. Pat. No. 4,512,292; and *Outboard Service Training Notebook,* Brunswick Corp. Bulletin 90-90592 3-1286, pages 108–109. The amount of pumped oil is varied by an adjusting lever on the oil pump. It is also known in the art to provide fuel-oil mixing valves with oil pumping chambers, wherein the amount of oil pumped and the fuel-oil ratio is determined by the volume of such chamber, for example U.S. Pat. No. 4,583,500.

The present invention provides a particularly simple, low cost oil injection system, and also provides accurate control of the fuel-oil ratio.

DESCRIPTION OF THE PRIOR ART

Figure 1:
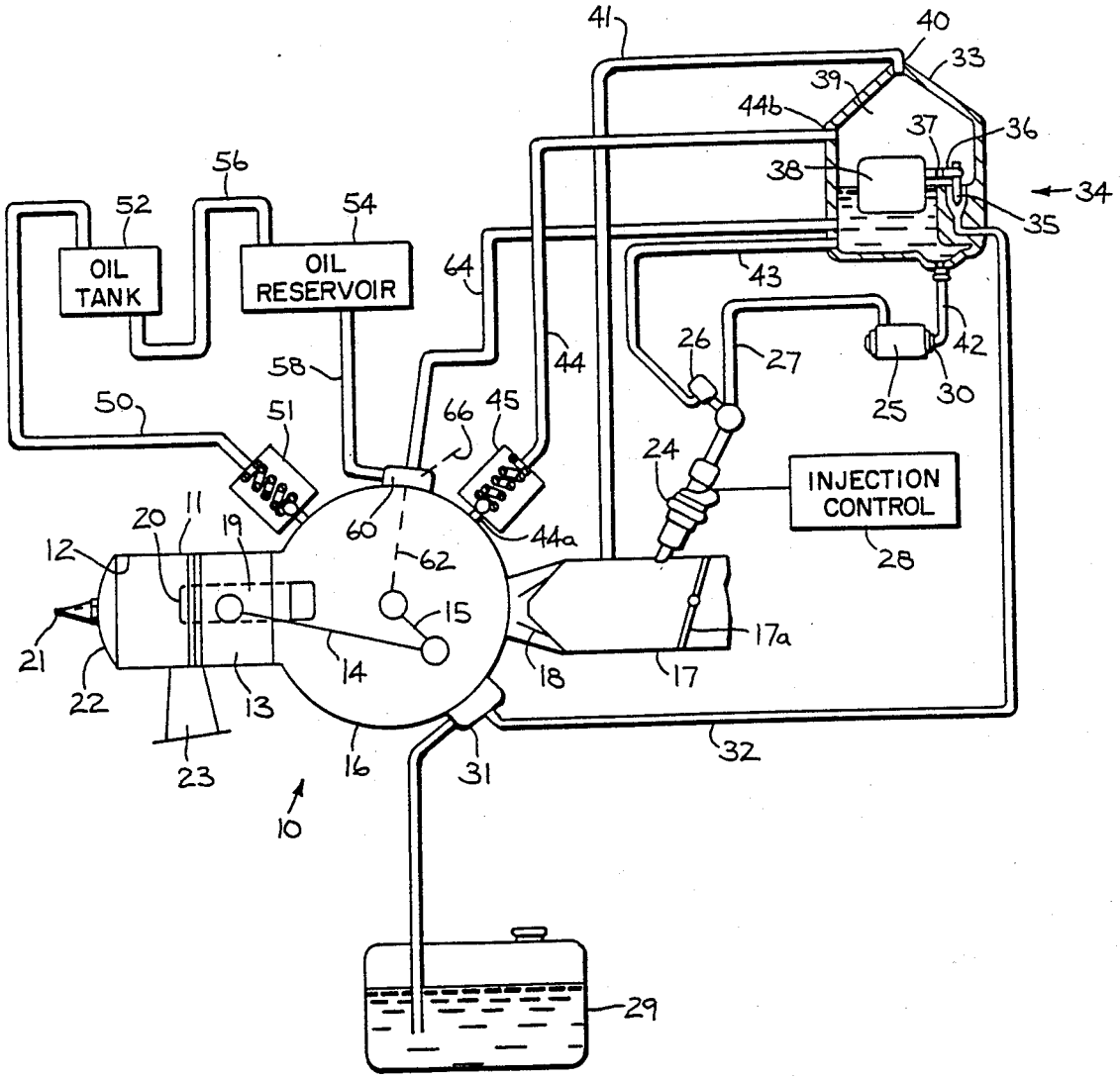
FIG. 1 PRIOR ART
FIG. 1 schematically illustrates an oil injection system known in the prior art.

FIG. 1 shows one cylinder of a two cycle crankcase compression internal combustion engine 10. The engine includes a cylinder block 11 having a cylinder bore 12 in which a piston 13 is supported for reciprocation. The piston 13 is connected by connecting rod 14 to crankshaft 15 which is journaled for rotation in crankcase 16 of engine 10. The engine includes an induction system with air intake manifold 17 having throttle valve **17*a* and supplying combustion air to crankcase 16. One-way reed check valve 18 permits flow from manifold 17 into crankcase 16, and prevents reverse flow out of crankcase 16 intoo manifold 17. A transfer passage 19 extends from crankcase 16 through cylinder block 11 and terminates at inlet port 20 in the cylinder wall at a point above the bottom dead center position of piston 13. A spark plug 21 is provided in the cylinder head 22 for firing the fuel-air charge. An exhaust port 23 is formed in cylinder bore 12** to discharge exhaust gases to the atmosphere.

Engine 10 is provided with a fuel injection system that includes an electromagnetically controlled injection nozzle 24 that discharges into induction manifold 17. Fuel, typically gasoline, is supplied to nozzle 24 by a high pressure fuel pump 25. A pressure regulator 26 is provided on the fuel supply line 27 to maintain an essentially constant fuel pressure at fuel injection nozzle 24. An electronic control 28 is provided to control the operation of injection nozzle 24 in known manner to deliver the desired amount of fuel to induction manifold 17 at the desired times.

During running of the engine, air is delivered to induction manifold 17 and fuel is injected by nozzle 24 to provide a fuel-air mixture which is admitted to crankcase 16 through reed valve 18 while piston 13 is moving upwardly toward spark plug 21. Reed valve 18 will open during these conditions as long as the pressure in crankcase 16 is lower than that in induction manifold 17. As piston 13 moves downwardly toward crankcase 16, exhaust port 23 will open to discharge spent combustion products, and intake port 20 will open to allow transfer of fuel-air mixture from crankcase 16 to cylinder 12. On the upstroke of piston 13, spark plug 21 is fired to ignite the mixture, and the cycle continues in conventional manner.

A vapor free supply of fuel from a remote fuel tank 29 is provided to the inlet 30 of high pressure fuel pump 25. A low pressure fuel pump 31, such as a diaphragm pump operated by the pulsating pressure in the engine's crankcase 16, is used to draw fuel from fuel tank 29. Such diaphragm pumps are commonly used on outboard motors and produce a fuel output closely matched to engine requirements. From the lower pressure pump 31 fuel is supplied by a fuel line 32 to a vapor separator 33. Admission of fuel from low pressure pump 31 to vapor separator 33 is controlled by a float operated valve 34. The valve member 35 is controlled by a lever 36 having a pivot point 37 fixed on the vapor separator 33 and attached to a float 38. The level of fuel in the vapor separator chamber 39 is thus controlled by the float operated valve 34. An opening 40 at the top of vapor separator chamber 39 is connected by a line 41 to induction manifold 17. The inlet 30 of high pressure fuel pump 25 is connected by fuel line 42 to draw fuel from the bottom of the vapor separator chamber 39. An excess fuel return line 43 from pressure regulator 26 returns excess fuel to the vapor separator chamber 39 for recirculation.

A puddled fuel return line 44 has an inlet **44*a* connected to a low point of crankcase 16 and has an outlet 44*b* connected to vapor separator 33. Other puddle return fuel lines are connected to vapor separator 33 from each crankcase section of the respective remaining cylinders of the engine for recirculation of puddled fuel including heavy fuel ends. During the combustion power stroke of piston 13 away from spark plug 21, the puddled fuel is pumped from crankcase 16 through one-way check valve 45 to vapor separator 33 for recirculation. Valve 45 prevents reverse flow through line 44 back into crankcase 16**.

In operation, low pressure fuel pump 31 supplies fuel to vapor separator 33 through float controlled valve 34. The pressure in vapor separator 33 at the surface of the fuel will be held at or below atmospheric pressure by the connection through line 41 to induction manifold 17. Thus, fuel which vaporizes will be drawn from separator 33 and supplied through line 41 to induction manifold 17. Hence, vapor free fuel will be supplied through line 42 to inlet 30 of high pressure fuel injection pump 25. Separator 33 is also effective to remove vapors from the excess fuel returned to separator 33 from pressure regulator 26 through excess fuel return line 43. Separator 33 is also effective to remove vapors from the puddled fuel returned to separator 33 from crankcase 16 through puddled fuel return line 44.

FIG. 1 also shows an oil injection system as known in the art, for example U.S. Pat. No. 4,512,292, and *Outboard Service Training Notebook,* Brunswick Corp. Bulletin 90-90592 3-1286, pages 108–109. Air line 50 is connected between crankcase 16 and oil tank 52 to apply crankcase pressure through one-way check valve 51 to the oil tank and pressurize same. Oil reservoir 54 has an oil input line 56 receiving oil from oil tank 52, and has an oil output line 58 supplying oil to oil pump 60 which is driven by a worm gear arrangement 62 on crankshaft 15. Oil pump 60 draws fuel from reservoir 54 through line 58 and meters and pushes the oil through oil output line 64 to vapor separator 33 where it mixes with the fuel. The fuel-oil ratio is varied according to engine requirements by an adjusting lever 66 on oil pump 60 which is mechanically linked to the throttle so that the flow of oil is controlled by engine speed and load.

DESCRIPTION OF THE INVENTION

Figure 2:
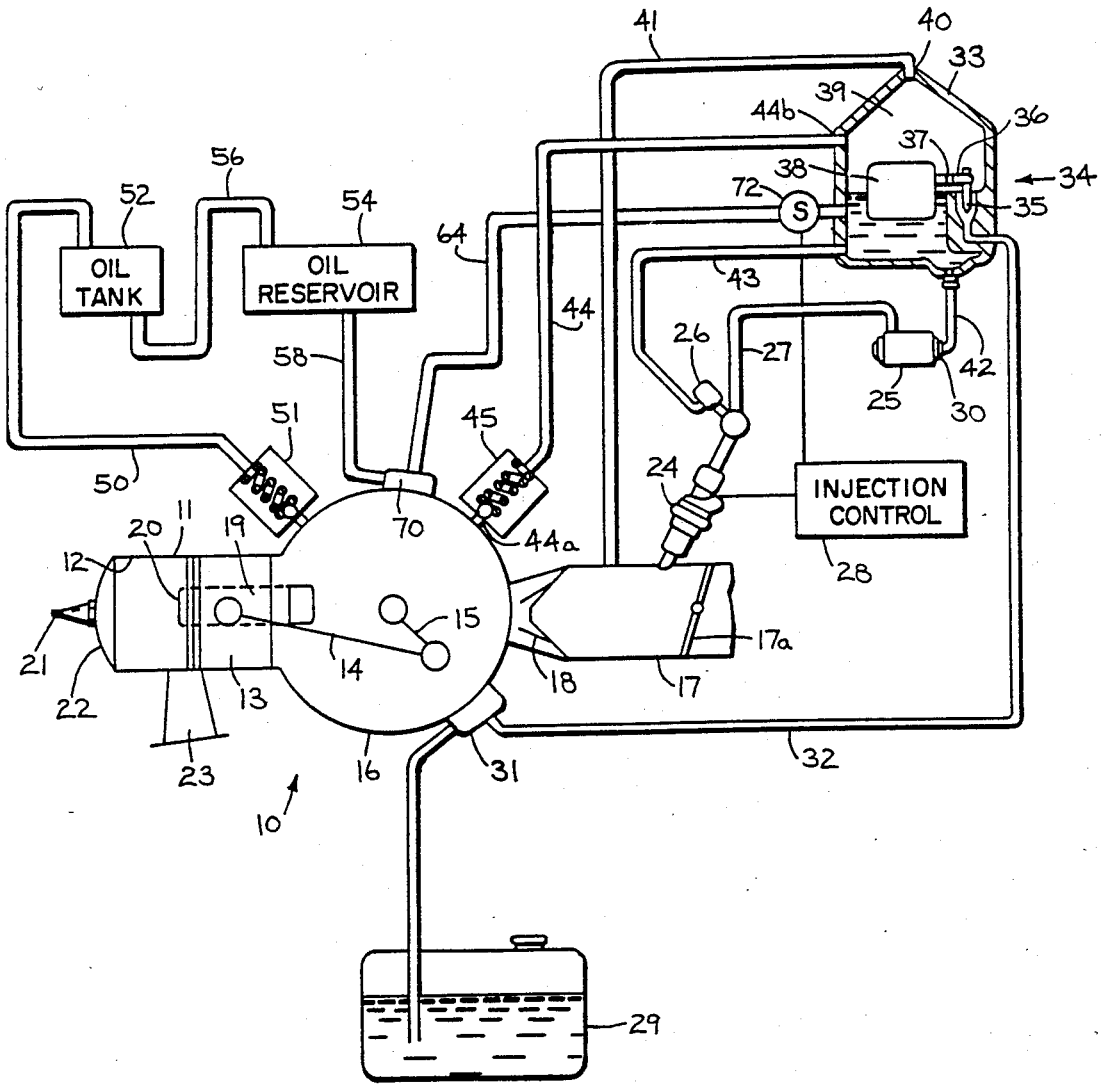
FIG. 2 shows an oil injection system in accordance with the invention.

FIG. 2 shows an oil injection system in accordance with the invention and uses like reference numerals from FIG. 1 where appropriate to facilitate clarity. Oil is drawn from reservoir 54 through oil input line 58 by a crankcase pressure driven oil pump 70 directly mounted to crankcase 16 and directly communicating with crankcase pressure. Pump 70 is identical to pump 31, except that pump 70 pumps oil, while pump 31 pumps fuel. Pump 70 is a standard low pressure crankcase pressure driven pump, for example as shown in *Outboard Service Training Notebook*, Brunswick Corp. Bulletin 90-90592 3-1286, pp. 10–11, and for example as shown in U.S. Pat. No. 3,924,975, incorporated herein by reference.

Pump 70 delivers pumped oil through oil output line 64 to the fuel supply system at vapor separator 33. A solenoid valve 72, Mercury Marine Part No. 14627, is provided in oil output line 64 and controls the flow of pumped oil to vapor separator 33. Both fuel injector 24 and solenoid 72 are controlled by injection control 28. This type of injection control is known in the art, for example as shown in U.S. Pat. No. 4,305,351, and allowed application Ser. No. 07/025,270, filed Mar. 12, 1987, incorporated herein by reference, and provides a variable pulse with which controls the amount of fuel injected at injector 24 and controls the amount of oil metered and injected through solenoid valve 72.

The invention may also be used in carbureted engines, for example with output oil line 64 and solenoid 72 connected to the float bowl of the carburetor.

It is recognized that various equivalents, alternatives and modifications are possible within the scope of the appended claims.

I claim:

1. An oil injection system for a two cycle crankcase compression internal combustion engine having a fuel system supplying fuel to said engine, an oil source, an oil pump drawing oil from said oil source through an oil input line and delivering pumped oil through an oil input line to said fuel supply system, a solenoid valve in said oil output line controlling the flow of pumped oil to said fuel supply system, wherein said oil pump is a crankcase pressure driven oil pump.

2. The invention according to claim 1 wherein said crankcase pressure driven oil pump is directly mounted to said crankcase and directly communicates with crankcase pressure.

3. An oil injection system for a two cycle crankcase compression internal combustion engine having an induction system supplying combustio air to the engine, fuel injection means mixing fuel with the combustion air, a fuel tank, an oil source, a first fuel pump connected to draw fuel from said fuel tank, a second fuel pump connected to receive fuel from said first fuel pump and provide fuel under pressure to said fuel injection means, a vapor separator connected between said first and second fuel pumps to remove fuel vapors supplied to said second fuel pump, a pressure regulator regulating the output pressure of said second fuel pump at said fuel injection means and returning excess fuel through an excess fuel return line to said vapor separator for recirculation, a crankcase pressure driven oil pump drawing oil from said oil source and delivering pumped oil through an oil output line to said vapor separator, a solenoid value in said oil output line controlling the flow of pumped oil to said vapor separator for mixing with fuel therein.

4. The invention according to claim 3 comprising injection control means controlling said fuel injection means, and wherein said solenoid valve is also controlled by said injection control means to control the fuel-oil ratio.

5. The oil injection system for a two cycle crankcase compression internal combustion engine having a fuel supply system supplying fuel to said engine, an oil supply system supplying oil to said fuel supply system, fuel supply control means controlling the amount of fuel supplied to said engine by said fuel supply system, a solenoid valve in said oil supply system controlling the amount of oil supplied to said fuel supply system by said oil supply system, said solenoid valve being controlled by said fuel supply control means to control the fuel-oil ratio.

6. The invention according to claim 5 wherein both said fuel supply system and said solenoid valve are controlled by said fuel supply control means to variably control the amount of fuel supplied to said engine and also the amount of oil supplied to said fuel supply system during running of said engine.

* * * * *

UNITED STATES PATENT AND TRADEMARK OFFICE

CERTIFICATE OF CORRECTION

PATENT NO. : 4,887,559

DATED : December 19, 1989

INVENTOR(S) : ROBERT J. HENSEL ET AL

It is certified that error appears in the above-identified patent and that said Letters Patent is hereby corrected as shown below:

Claim 1, column 3, line 48, delete "input" and substitute therefore -- output --; claim 3, column 4, line 9, delete "combustio" and substitute therefore -- combustion --.

Signed and Sealed this

Ninth Day of April, 1991

*Attest:*

HARRY F. MANBECK, JR.

*Attesting Officer*

*Commissioner of Patents and Trademarks*